US008771493B2

(12) United States Patent
Fan et al.

(10) Patent No.: US 8,771,493 B2
(45) Date of Patent: Jul. 8, 2014

(54) LIQUID DIELECTROPHORETIC DEVICE AND METHOD FOR CONTROLLABLY TRANSPORTING A LIQUID USING THE SAME

(75) Inventors: Shih-Kang Fan, Hsinchu (TW); I-Pei Lu, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 0 days.

(21) Appl. No.: 13/179,253

(22) Filed: Jul. 8, 2011

(65) Prior Publication Data

US 2012/0118736 A1 May 17, 2012

(30) Foreign Application Priority Data

Nov. 15, 2010 (TW) ..... 99139192 A

(51) Int. Cl.
*C25B 11/02* (2006.01)

(52) U.S. Cl.
USPC ..... 204/643; 204/409; 204/411

(58) Field of Classification Search
CPC ..... G01N 27/4473; C25B 9/00; C25B 9/06; C25B 9/142; C25B 9/16; C25B 15/00; C25B 15/02; C25B 11/02; C25B 11/00; C25B 11/0405; B01D 53/326; B01D 57/02; B01L 2400/0427; B01L 2400/0424; B01L 2400/0415; B01L 2300/161; B01L 2300/0636; B01L 2300/0861; B01L 2200/0605; B01L 2200/0647; B01L 2200/0668; B01L 2200/0673; B81B 1/00
USPC ..... 204/409, 411, 547, 643; 422/502, 603
See application file for complete search history.

(56) References Cited

U.S. PATENT DOCUMENTS

| | | | | |
|---|---|---|---|---|
| 4,938,742 | A | 7/1990 | Smits | 604/67 |
| 7,316,543 | B2 | 1/2008 | Goodson et al. | 417/50 |
| 2010/0260626 | A1 * | 10/2010 | Fajolle | 417/413.2 |

FOREIGN PATENT DOCUMENTS

WO WO 2009076414 A2 * 6/2009

OTHER PUBLICATIONS

Fan, Shih-Kang, et al. "Reconfigurable liquid pumping in electric-field-defined virtual microchannels by dielectrophoresis" Lab Chip, pp. 1590-1595, 2009.
Koch, M., et al. "A Novel Micropump design with thick-film Piezo-electric Actuation", Meas. Sci. Technology, pp. 49-57, 1997.
Gitlin, Irina, et al. "Pumping based on transverse electrokinetic effects", Applied Physics Letters, vol. 83 No. 7, pp. 1486-1488, 2003.

* cited by examiner

*Primary Examiner* — Susan D Leong
(74) *Attorney, Agent, or Firm* — Ladas & Parry, LLP

(57) ABSTRACT

A liquid dielectrophoretic device comprises: a first container unit defining a first micro containing space including an electrode pair for generating a dielectrophoretic force; a second container unit defining a second micro containing space and including an electrode pair for generating a dielectrophoretic force; and a fluid channel unit defining a micro-channel between the first and second micro containing spaces and including an electrode pair having a middle region layer that has first and second enlarged sections and a middle section disposed between the first and second enlarged sections. The first and second enlarged sections are enlarged gradually from the middle section to the first and second micro containing spaces. A method for controllably transporting a liquid using the liquid dielectrophoretic device is also disclosed.

7 Claims, 7 Drawing Sheets

LIQUID DIELECTROPHORETIC DEVICE AND METHOD FOR CONTROLLABLY TRANSPORTING A LIQUID USING THE SAME

CROSS-REFERENCE TO RELATED APPLICATIONS

This application claims priority of Taiwanese Patent Application No. 099139192 filed on Nov. 15, 2010, the disclosures of which is incorporated herein by reference.

BACKGROUND OF THE INVENTION

1. Field of the Invention

The invention relates to a liquid dielectrophoretic device and a method for controllably transporting a liquid using the liquid dielectrophoretic device.

2. Description of the Related Art

Microfluidic systems or microfluidic chips have been utilized widely in the biotechnological field, the pharmaceutical field, electro optical field, etc., due to their high responsiveness, high sensitivity, high reproducibility, low cost, and low pollution. Microfluidic systems can drive fluids in a mechanical manner or an electrokinetic manner. The electrokinetic manner can be performed through dielectrophoresis or electro-osmosis.

Fan et al. "Reconfigurable liquid pumping in electric-field-defined virtual microchannel by dielectrophoresis", Lab Chip, pp. 1590-1595, vol. 9, 2009, disclose a conventional liquid dielectrophoretic device (see FIG. 1). The liquid dielectrophoretic device includes upper and lower electrode plates 21 22 that cooperate to define a virtual micro channel 20 for receiving a liquid 100 (the boundary of the liquid 100 in the micro channel 20 is not confined and limited by a real wall but by an electric field in the micro channel 20). The boundary of the liquid 100 in the micro channel 20 is defined by the shape of the lower electrode plate 22. The lower electrode plate 22 has opposite first and second end portions 221, 222. When the liquid 100 is disposed on the first end portion 221 of the lower electrode 22 and when an electric field is formed in the micro channel 20, a dielectrophoretic force is generated to drive flow of the liquid 100 disposed on the first end portion 221 to the second end portion 222. However, the conventional liquid dielectrophoretic device is insufficient to effectively control the flow rate of the liquid.

SUMMARY OF THE INVENTION

The object of the present invention is to provide a liquid dielectrophoretic device that can effectively control the flow rate of a liquid in the liquid dielectrophoretic device.

According to one aspect of the present invention, there is provided a liquid dielectrophoretic device that comprises: a first container unit defining a first micro containing space for containing a liquid therein and including an electrode pair for generating a dielectrophoretic force acting on the liquid in the first micro containing space by forming an electric field in the first micro containing space, the electrode pair having a first region layer; a second container unit defining a second micro containing space for containing the liquid therein and including an electrode pair for generating a dielectrophoretic force acting on the liquid in the second micro containing space by forming an electric field in the second micro containing space, the electrode pair of the second containing unit having a second region layer; and a fluid channel unit defining a micro-channel and including an electrode pair for forming an electric field in the micro-channel. The electrode pair of the fluid channel unit has a middle region layer that has first and second enlarged sections and a middle section disposed between the first and second enlarged sections. The first enlarged section is disposed between the first region layer and one end of the middle section and is enlarged in width from one end thereof that is distal from the first region layer to the other end thereof that is proximate to the first region layer. The second enlarged section is disposed between the second region layer and the other end of the middle section and is enlarged in width from one end thereof that is distal from the second region layer to the other end thereof that is proximate to the second region layer. The liquid in one of the first and second micro containing spaces can be controllably transported to the other of the first and second micro containing spaces through the micro-channel by varying the difference between the electric field in said one of the first and second micro containing spaces and the electric field in the other of the first and second micro containing spaces.

According to another aspect of the present invention, there is provided a liquid dielectrophoretic device that comprises: a first container unit defining a first micro containing space for containing a liquid therein and including an electrode pair for generating a dielectrophoretic force acting on the liquid in the first micro containing space by forming an electric field in the first micro containing space, the electrode pair having a first region layer; a second container unit defining a second micro containing space for containing the liquid therein and including an electrode pair for generating a dielectrophoretic force acting on the liquid in the second micro containing space by forming an electric field in the second micro containing space, the electrode pair of the second containing unit having a second region layer; and a fluid channel unit defining a micro-channel between the first and second region layers of the first and second container units, and including first and second enlarged sections proximate to the first and second region layers, respectively, and a middle section connected between the first and second enlarged sections, the first and second enlarged sections being enlarged gradually from the middle section to the first and second region layers, respectively. Preferably, the first and second enlarged sections respectively have largest widths that are adjacent to and substantially as large as those of the first and second region layers of the first and second container units, respectively.

In an embodiment, the fluid channel unit further includes an electrode pair for forming an electric field in the micro-channel. The electrode pair of the fluid channel unit has a middle region layer disposed between the first and second region layers. The middle region layer defines the micro-channel and has the middle section and the first and second enlarged sections.

In another embodiment, the fluid channel unit further includes a capillary that defines the micro-channel and that has the first and second enlarged sections and the middle section. The first and second enlarged sections of the capillary are in spatial communication with the first and second micro containing spaces, respectively.

According to still another aspect of the invention, there is provided a method for controllably transporting a liquid using a liquid dielectrophoretic device that includes first and second container units and a fluid channel unit, the first container unit defining a first micro containing space and including an electrode pair, the second container unit defining a second micro containing space and including an electrode pair, the first micro containing space being in fluid communication with the second micro containing space via the fluid channel unit.

The method comprises:

forming a continuous phase of a liquid in the fluid channel unit and the first and second micro containing spaces;

applying a first voltage to the electrode pair of the first container unit to generate a dielectrophoretic force acting on the liquid in the first micro containing space by forming an electric field in the first micro containing space;

applying a second voltage to the electrode pair of the second container unit so as to generate a dielectrophoretic force acting on the liquid in the second micro containing space by forming an electric field in the second micro containing space; and varying the difference between the respective electric fields in the first and second micro containing spaces to regulate a flow rate of the liquid between the first and second micro containing spaces.

BRIEF DESCRIPTION OF THE DRAWINGS

In drawings which illustrate embodiments of the invention.

DETAILED DESCRIPTION OF THE PREFERRED EMBODIMENTS

Figure 1:
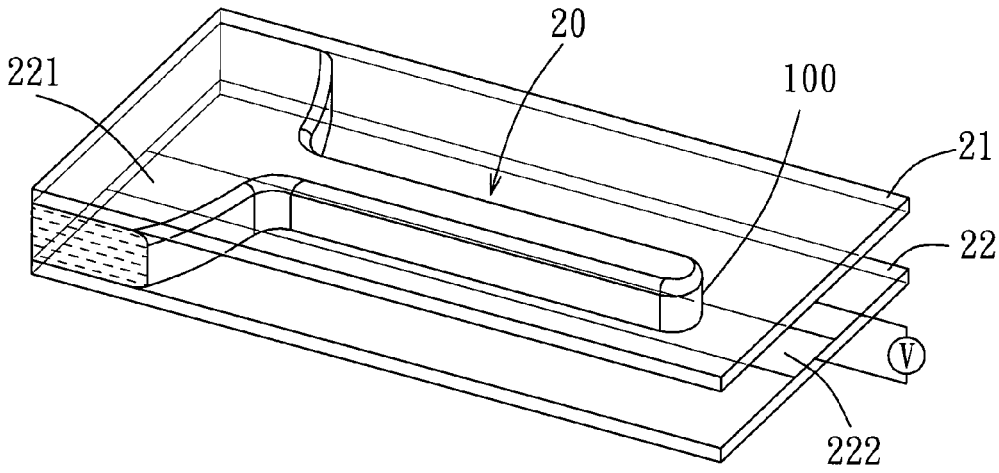
FIG. 1 PRIOR ART
FIG. 1 is a perspective view of a conventional liquid dielectrophoretic device.
Figure 2:
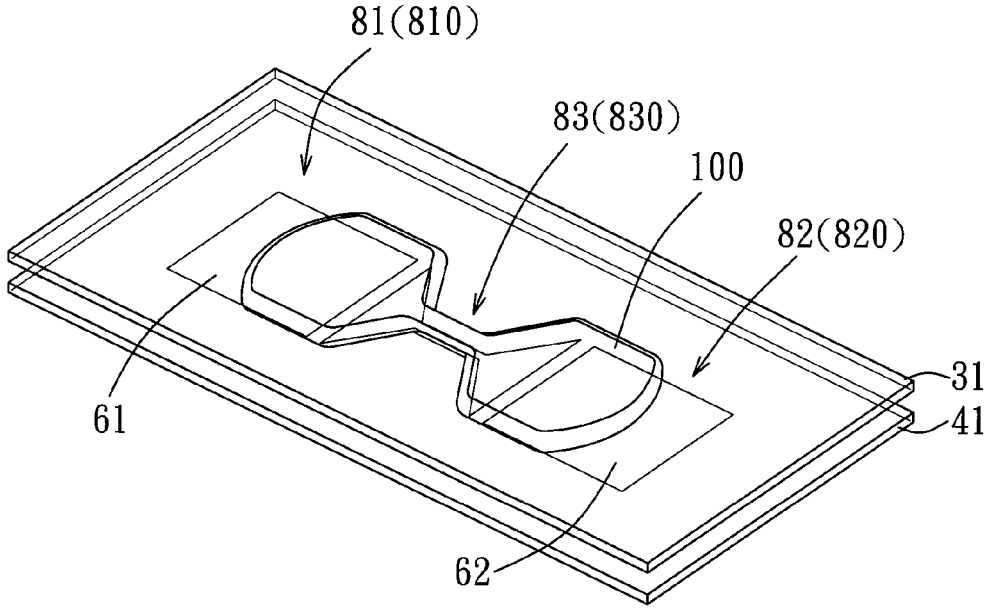
FIG. 2 is a perspective view of the first preferred embodiment of a liquid dielectrophoretic device according to this invention.
Figure 3:
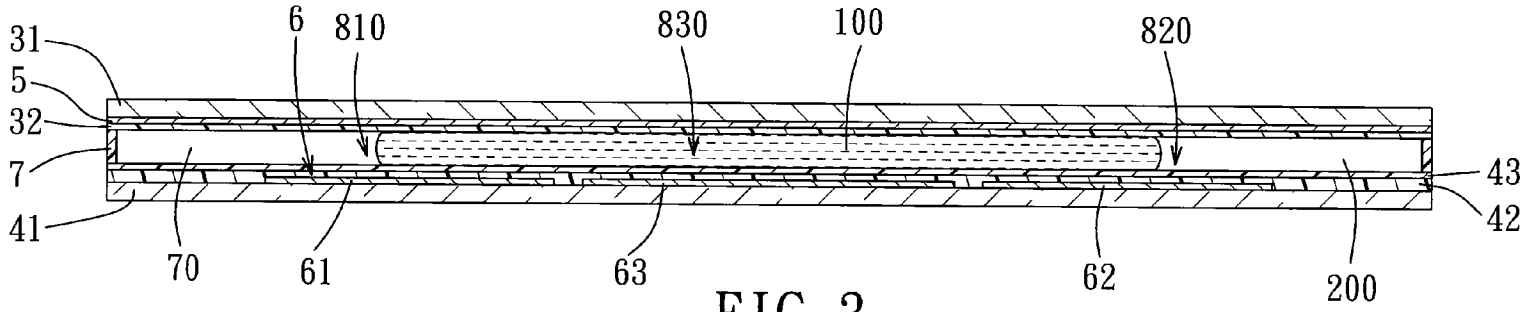
FIG. 3 is a sectional view of the first preferred embodiment.
Figure 4:
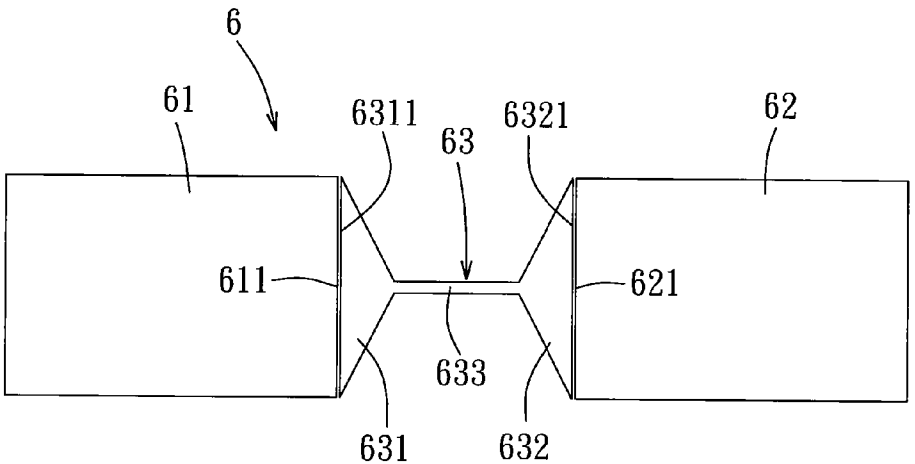
FIG. 4 is a schematic top view of a lower electrode layer of the first preferred embodiment.

FIGS. 2 to 4 illustrate the first preferred embodiment of a liquid dielectrophoretic device for transporting a liquid 100 therein. The liquid dielectrophoretic device includes an upper substrate 31, an upper electrode layer 5 formed on the upper substrate 31, an upper hydrophobic layer formed on the upper electrode layer 5, a lower substrate 41 opposite to the upper substrate 31, a lower electrode layer 6 formed on the lower substrate 41, a dielectric layer 42 formed on the lower substrate 41 and the lower electrode layer 6 to cover entirely the lower electrode layer 6, a lower hydrophobic layer 43 formed on the dielectric layer 42, and a spacer 7 disposed between and cooperating with the upper and lower hydrophobic layers 32, 43 to define an accommodating space 70 thereamong.

The upper electrode layer 5 is not patterned. The lower electrode layer 6 is patterned and includes first and second region layers 61, 62 opposite to each other, and a middle region layer 63 disposed between and spaced apart from the first and second region layers 61, 62. In this embodiment, each of the first and second region layers 61, 62 is rectangular (2500 μm×2000 μm) in shape, and the middle region layer 63 has a dumbbell-like shape. The first region layer 61 cooperates with the upper electrode layer 5 to define a first container unit 81 in the accommodating space 70. The second region layer 62 cooperates with the upper electrode layer 5 to define a second container unit 82 in the accommodating space 70. The middle region layer 63 cooperates with the upper electrode layer 5 to define a fluid channel unit 83 in the accommodating space 70. It is noted that variations of the structure of the liquid dielectrophoretic device can be made based on the actual requirements in different applications. For instance, in other applications, the upper electrode layer 5 may have a pattern of a plurality of spaced apart conductors, the upper and lower hydrophobic layers 32, 43 or the dielectric layer 42 may be dispensed with, or the liquid dielectrophoretic device may further includes an upper dielectric layer interposed between the upper electrode layer 5 and the upper hydrophobic layer 32.

The first container unit 81 defines a first micro containing space 810 for containing the liquid 100 therein, and includes an electrode pair defined by the first region layer 61 and the upper electrode 5 for generating a dielectrophoretic force acting on the liquid 100 in the first micro containing space 810 by forming an electric field in the first micro containing space 810. It is noted that another fluid 200, such as air or silicone oil, is also received in the accommodating space to surround the liquid 100. The first region layer 61 of the lower electrode layer 6 defines the boundary of the electric field generated thereby, which, in turn, defines the boundary or the shape of the first micro containing space 810.

The second container unit 82 defines a second micro containing space 820 for containing the liquid 100 therein, and includes an electrode pair defined by the second region layer 62 and the upper electrode 5 for generating a dielectrophoretic force acting on the liquid 100 in the second micro containing space 820 by forming an electric field in the second micro containing space 820. The second region layer 62 of the lower electrode layer 6 defines the boundary of the electric field generated thereby, which, in turn, defines the boundary or the shape of the second micro containing space 820.

The fluid channel unit 83 defines a micro-channel 830, and includes an electrode pair defined by the middle region layer 63 and the upper electrode 5 for forming an electric field in the micro-channel 830. The middle region layer 63 of the lower electrode layer 6 defines the boundary of the electric field generated thereby, which, in turn, defines the boundary or the shape of the micro-channel 830. The middle region layer 63 has first and second enlarged sections 631, 632 and a middle section 633 (having a width of 100 μm.) disposed between the first and second enlarged sections 631, 632. The first enlarged section 631 is disposed between the first region layer 61 and one end of the middle section 633 and is enlarged in width from one end thereof that is distal from the first region layer 61 to the other end 6311 thereof that is proximate to the first region layer 61. The second enlarged section 632 is disposed between the second region layer 62 and the other end of the middle section 633 and is enlarged in width from one end thereof that is distal from the second region layer 62 to the other end 6321 thereof that is proximate to the second region layer 62.

Since the dielectrophoretic forces acting on the liquid 100 in the first micro containing space 810 and on the liquid 100 in the second micro containing space 820 are opposite to each other, the higher the difference between the dielectrophoretic forces, the higher the driving force to drive the liquid 100 to flow from one of the first and second micro containing spaces 810, 820 to the other of the first and second micro containing spaces 810, 820. Hence, by varying the difference between the electric field in one of the first and second micro containing spaces 810, 820 and the electric field in the other of the first and second micro containing spaces 810, 820, the flow rate of the liquid 100 from one of the first and second micro containing spaces 810, 820 to the other of the first and second micro containing spaces 810, 820 can be controlled.

In this embodiment, the first region layer 61 has an end 611 that is proximate to and spaced apart from the end 6311 of the first enlarged section 631 of the middle region layer 63 by a distance of 10 μm and that has a width substantially the same as that of the end 6311 of the first enlarged section 631 of the middle region layer 63. Similarly, the second region layer 62 has an end 621 that is proximate to and spaced apart from the end 6321 of the second enlarged section 632 of the middle region layer 63 by a distance of 10 μm and that has a width substantially the same as that of the end 6321 of the second enlarged section 632 of the middle region layer 63. The aforesaid distances can be varied based on the shapes and sizes of the middle region layer 63 and the first and second region layers 61, 62.

Preferably, the upper and lower substrates 31, 41 are made of glass, and the upper and lower electrode layers 5, 6 are made of indium tin oxide (ITO). The upper and lower hydrophobic layers 32, 43 are preferably made of Teflon.

When the liquid 100 is to be transported from the first micro containing space 810 to the second micro containing space 820 using the preferred embodiment, the following consecutive steps are performed: injecting the liquid 100 into the first micro containing space 810, forming a first electric field in the first micro containing space 810 by applying a voltage to the electrode pair of the first container unit 81 so as to confine the liquid 100 in the first micro containing space 810, forming an electric field higher than the first electric field in the micro-channel 830 by applying a voltage to the electrode pair of the fluid channel unit 83 so as to drive the liquid 100 to flow into and to fill the micro-channel 830, and forming a second electric field higher than the electric field in the first micro containing space 810 by applying a voltage to the electrode pair of the second container unit 82 so as to drive the liquid 100 to flow into the second micro containing space 820. It is noted that as soon as the liquid 100 flows from the micro-channel 830 into the second micro containing space 820, the liquid 100 can be transported from the first micro containing space 810 to the second micro containing space 820 so long as the electric field in the second micro containing space 820 is higher than the electric field in the first micro containing space 810 no matter whether the input of the voltage to the electrode pair of the fluid channel unit 83 is stopped or continues.

Hence, a method for controllably transporting the liquid 100 using the liquid dielectrophoretic device can be provided. The method includes the steps of: forming a continuous phase of the liquid 100 in the fluid channel unit 83 and the first and second micro containing spaces 810, 820; applying a first voltage to the electrode pair of the first container unit 81 so as to generate a dielectrophoretic force acting on the liquid 100 in the first micro containing space 810 by forming an electric field in the first micro containing space 810; applying a second voltage to the electrode pair of the second container unit 820 so as to generate a dielectrophoretic force acting on the liquid 100 in the second micro containing space 820 by forming an electric field in the second micro containing space 820; and adjusting at least one of the voltages applied to the electrode pairs of the first and second container units 81, 82 to vary the difference between the first and second electric fields to thereby adjust the difference between the dielectrophoretic forces acting on the liquid 100 in the first micro containing space 810 and the liquid 100 in the second micro containing space 820, respectively, thereby permitting controlling of the flow rate of the liquid 100 from one of the first and second micro containing spaces 810, 820 to the other of the first and second micro containing spaces 810, 820 through the micro-channel 830.

Figure 5:
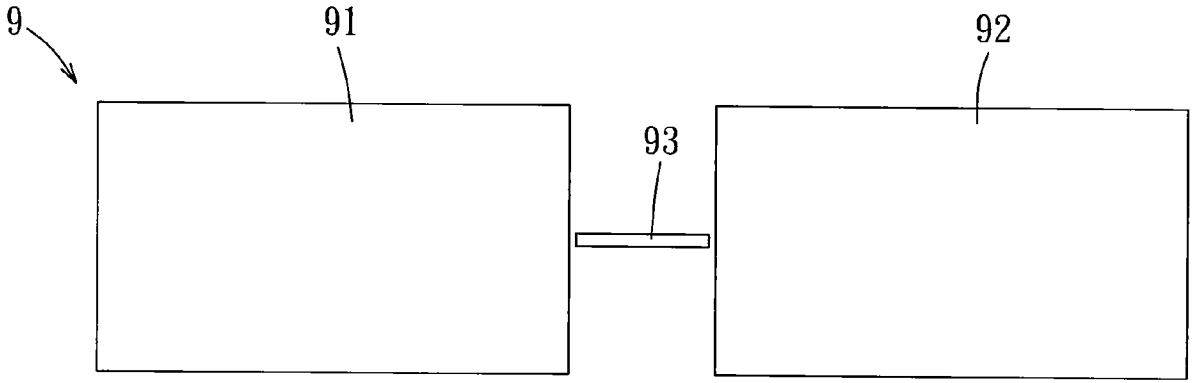
FIG. 5 is a schematic top view of a lower electrode layer of a liquid dielectrophoretic device of Comparative Example 1.
Figure 6:
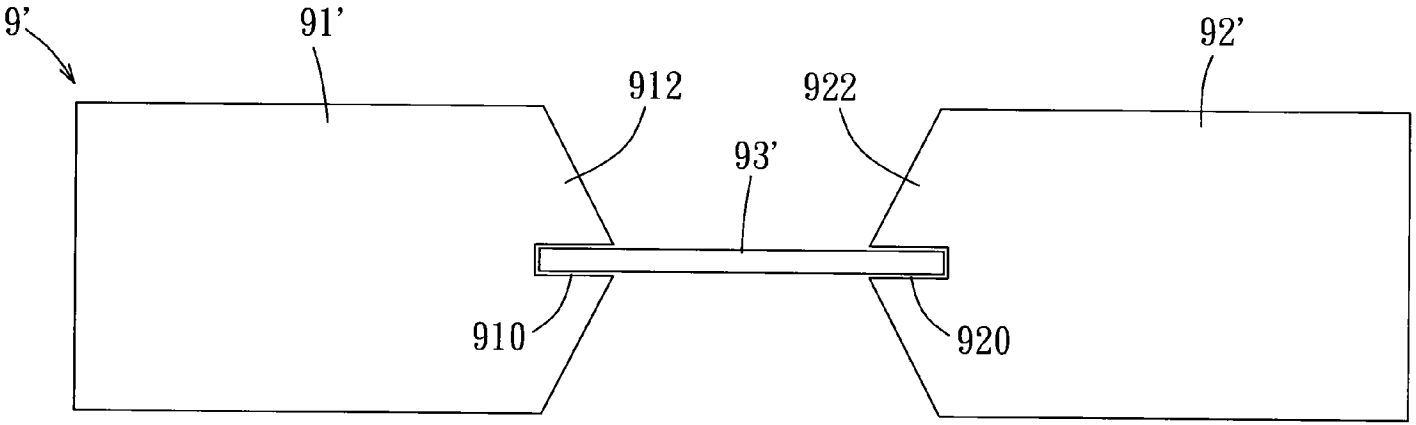
FIG. 6 is a schematic top view of a lower electrode layer of a liquid dielectrophoretic device of Comparative Example 2.
Figure 7A:
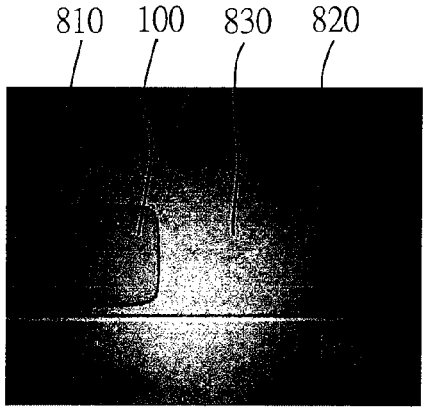
FIGS. 7A-7F are photo images illustrating how a liquid is transported by dielectrophoresis from a first micro containing space to a second micro containing space via a micro channel.
Figure 7B:
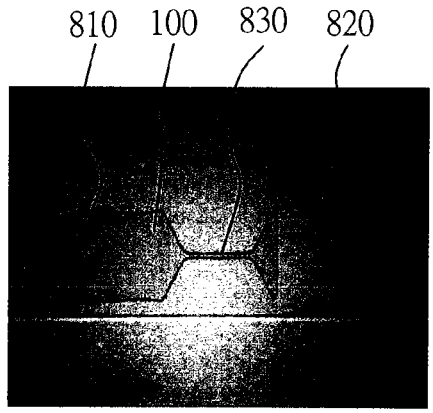
Figure 7C:
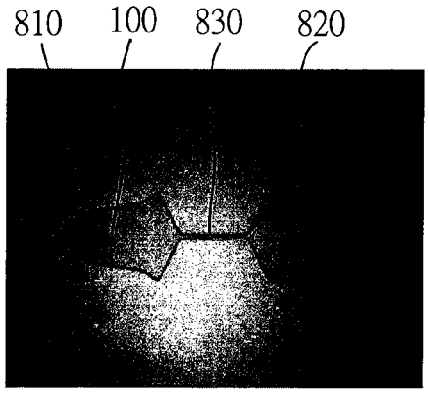
Figure 7D:
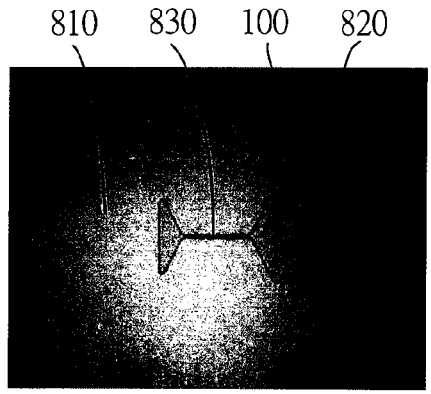
Figure 7E:
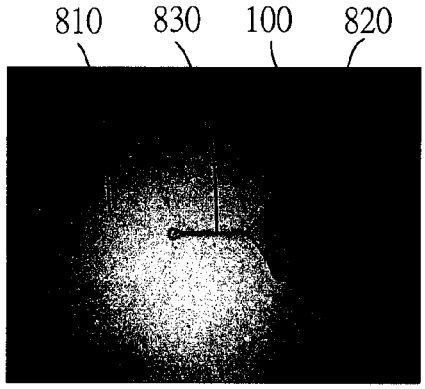
Figure 7F:
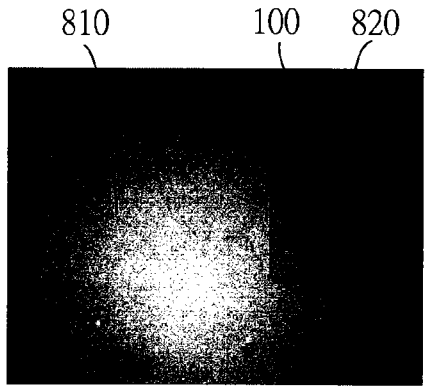

FIG. 5 illustrates the structure of a lower electrode layer 9 of Comparative Example 1 of a liquid dielectrophoretic device. The lower electrode layer 9 includes a first region layer 91, a second region layer 92 and a middle region layer 93 disposed between the first and second region layers 91, 92. Comparative Example 1 differs from the first preferred embodiment in that the middle region layer 93 has a rectangular band-like shape. FIG. 6 illustrates the structure of a lower electrode layer 9' of Comparative Example 2 of a liquid dielectrophoretic device. The lower electrode layer 9' includes a first region layer 91', a second region layer 92' and a middle region layer 93' disposed between the first and second region layers 91', 92'. Comparative Example 2 differs from the first preferred embodiment in that each of the first and second region layers 91', 92' has one tapered end 912, 922 formed with a recess 910, 920 and that the middle region layer 93' has a rectangular band-like shape and extends into the recesses 910, 920. Performance tests on the transportation of the liquid 100 for the liquid dielectrophoretic devices of Comparative Example 1 and 2 were conducted. Experimental results show that undesired breaking of the flow of the liquid 100 from one of the first and second region layers 91, 92 (or 91', 92') to the other of the first and second region layers 91, 92 (or 91', 92') occurs and the flow of the liquid 100 is interrupted.

As compared to Comparative Examples 1 and 2, the performance test on the transportation of the liquid 100 for the first preferred embodiment (see FIGS. 7A to 7F) shows that the liquid 100 can flow smoothly from one of the first and second micro containing spaces 810, 820 to the other of the first and second micro containing spaces 810, 820 through the micro-channel 830 and that no breaking of the flow of the liquid 100 occurs.

Figure 8:
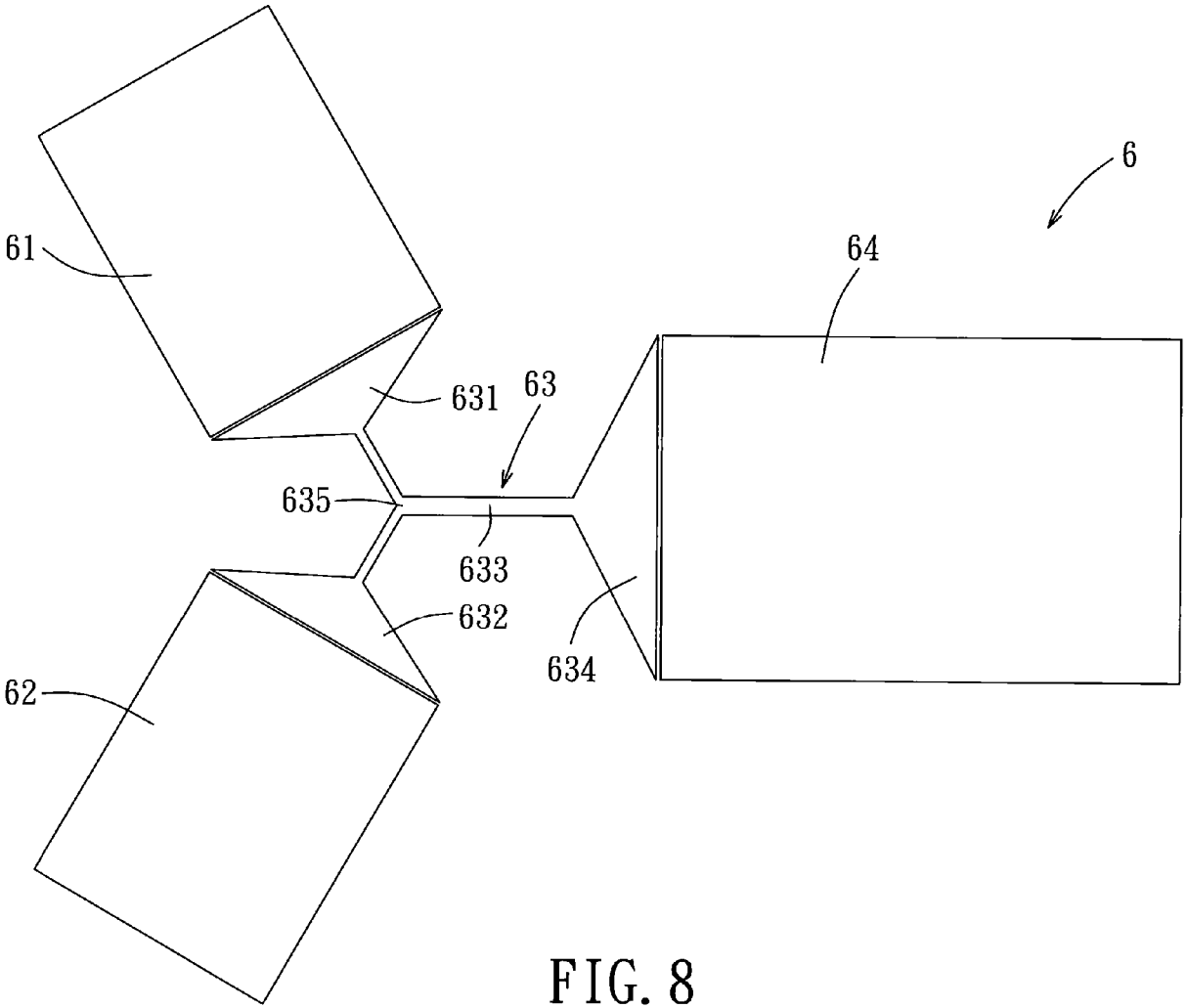
FIG. 8 is a schematic top view of the second preferred embodiment of a liquid dielectrophoretic device according to this invention, illustrating the structure of a lower electrode layer.

FIG. 8 illustrates the second preferred embodiment of the liquid dielectrophoretic device according to the present invention. The second preferred embodiment differs from the previous embodiment as follows:

The lower electrode layer 6 additionally has a third region layer 64 that cooperates with the upper electrode layer 5 (FIG. 3) to form an electrode pair for generating a dielectrophoretic force in a third container unit (not shown) that has a third micro containing space (not shown) in the accommodating space 70 (FIG. 3). The middle region layer 63 further includes a third enlarged section 634 proximate to the third region layer 64. The middle section 633 of the middle region layer 63 is formed as a Y-shaped structure, and has three ends connected respectively to the first, second and third enlarged sections 631, 632, 634, respectively.

The second preferred embodiment can be used to mix two different liquids. When two different liquids (not shown) are to be mixed, the liquids are loaded at the first and second region layers 61, 62, respectively, followed by applying different voltages to the middle region layer 63 and the first, second and third region layers 61, 62, 63 so as to drive the liquids at the first and second region layers 61, 62 to flow to the third region layer 64 and to permit the liquids to mix together at an intersection 635 of the middle section 633 of the middle region layer 63.

Figure 9:
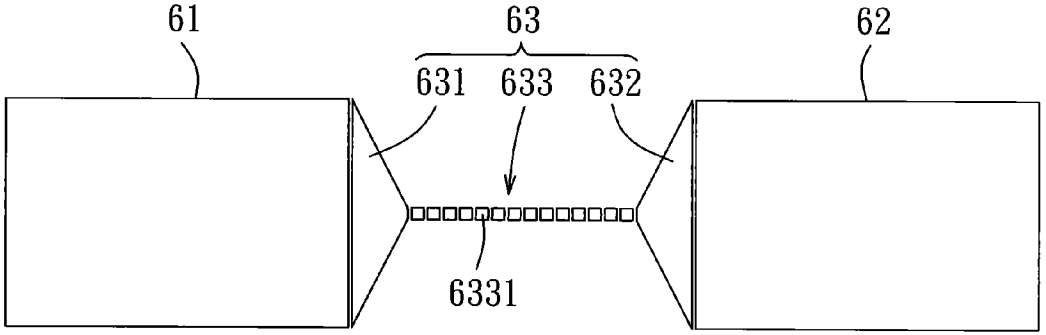
FIG. 9 is a schematic top view of the third preferred embodiment of a liquid dielectrophoretic device according to this invention, illustrating the structure of a lower electrode layer.

FIG. 9 illustrates the third preferred embodiment of the liquid dielectrophoretic device according to the present invention. The third preferred embodiment differs from the first preferred embodiment in that the middle section 633 of the middle region layer 63 of the lower electrode layer 6 includes a plurality of conductors 6331 spaced apart from each other and aligned along the length thereof. Two endmost ones of the conductors 6331 are spaced apart from the first and second enlarged sections 631, 632.

Figure 10:
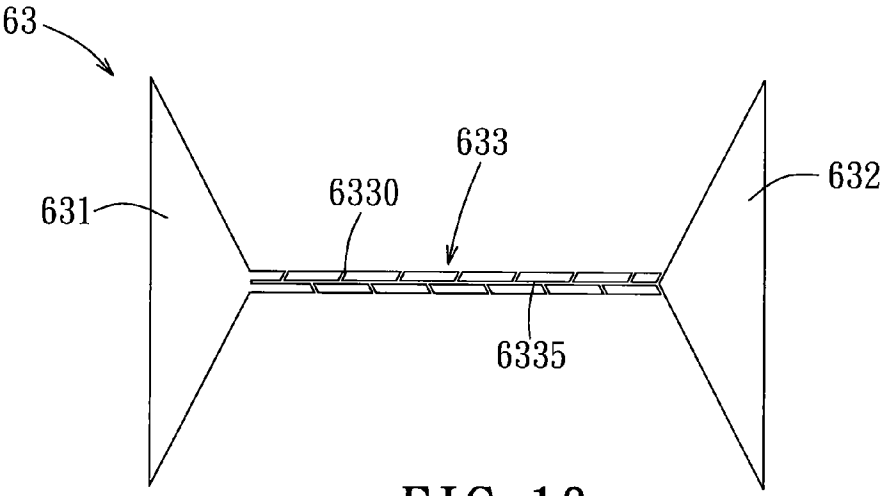
FIG. 10 is a schematic top view of the fourth preferred embodiment of a liquid dielectrophoretic device according to this invention, illustrating the structure of a lower electrode layer.

FIG. 10 illustrates the fourth preferred embodiment of the liquid dielectrophoretic device according to the present invention. The fourth preferred embodiment differs from the first preferred embodiment in that the middle section 633 of the middle region layer 63 of the lower electrode layer 6 is formed with a central passage 6335 extending along the length thereof and has two opposite sides, each of which is formed with a plurality of notches 6330 that are aligned along the length thereof and that are in fluid communication with the central passage 6335. The fourth preferred embodiment can be used to collect particles at the notches 6330 and the central passage 6335 when the liquid 100 carrying the particles passes through the middle section 633 of the middle region layer 63. The upper and lower hydrophobic layers 32, 43 and the dielectric layer 42 are not provided in this embodiment.

Figure 11:
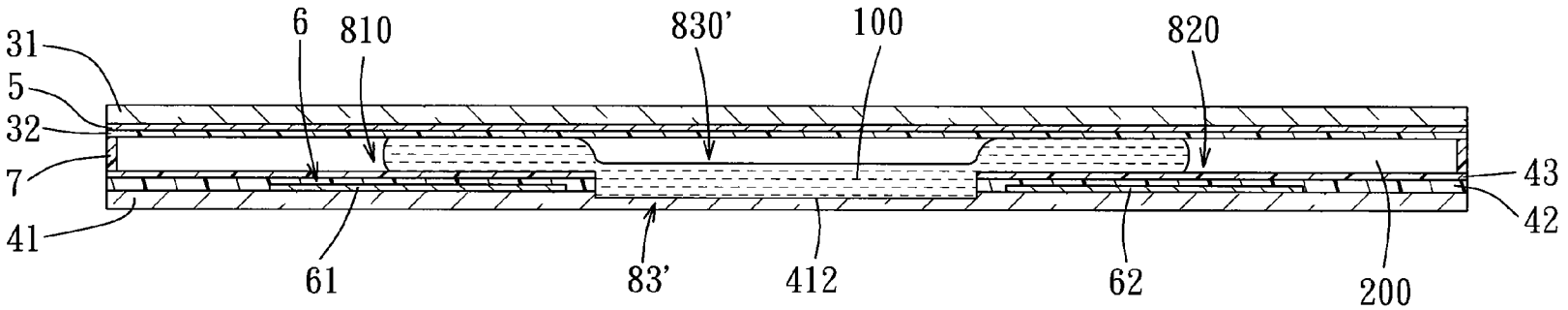
FIG. 11 is a sectional view of the fifth preferred embodiment of a liquid dielectrophoretic device according to this invention.

FIG. 11 illustrates the fifth preferred embodiment of the liquid dielectrophoretic device according to the present invention. The fifth preferred embodiment differs from the first preferred embodiment in that in the fifth preferred embodiment, the lower electrode layer 6 has no middle region layer 63, and a capillary 412 is formed in the lower hydrophophic layer 43, the dielectric layer 42, the lower electrode layer 6 and the lower substrate 41. The capillary 412 defines the micro-channel 830' of the fluid channel unit 83', which has two ends in spatial communication with the first and second micro containing spaces 810, 820, respectively. The capillary 412 may be configured to have a middle section and two enlarged sections like the middle region layer 63 of the first preferred embodiment. Alternatively, the capillary 412 may be configured to have a constant width throughout its length. The liquid 100 is permitted to flow from one of the first and second micro containing spaces 810, 820 to the other of the first and second micro containing spaces 810, 820 through the capillary 412 by dielectrophoresis.

By designing the middle region layer 63 of the lower electrode layer 6 to have the dumbbell-like shape, the liquid dielectrophoretic device of this invention can overcomes the undesired breaking of the flow of the liquid as encountered in Comparative Examples 1 and 2. In addition, by varying the difference between the electric fields in the first and second micro containing spaces 810, 820, the flow rate of the liquid 100 from one of the first and second micro containing spaces 810, 820 to the other of the first and second micro containing spaces 810, 820 can be controlled.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A liquid dielectrophoretic device comprising:

an upper assembly including an upper substrate and an upper electrode layer formed on said upper substrate:

a lower assembly including a lower substrate and a lower electrode layer formed on said lower substrate;

a first container unit defining a first micro containing space for containing a liquid therein and including an electrode pair for generating a dielectrophoretic force acting on the liquid in said first micro containing space by forming an electric field in said first micro containing space, said electrode pair being defined by said upper and lower electrode layers, and having a first region layer;

a second container unit defining a second micro containing space for containing the liquid therein and including an electrode pair for generating a dielectrophoretic force acting on the liquid in said second micro containing space by forming an electric field in said second micro containing space, said electrode pair of said second containing unit being defined by said upper and lower electrode layers, and having a second region layer;

a fluid channel unit defining a micro-channel and including an electrode pair for forming an electric field in said micro-channel, said electrode pair of said fluid channel unit being defined by said upper and lower electrode layers and having a middle region layer that has first and second enlarged sections and a middle section disposed between said first and second enlarged sections, said first enlarged section being disposed between said first region layer and one end of said middle section and having one end close to said first region layer and the other end close to said middle section, said first enlarged section increasing gradually in width from the middle section toward said first region layer and over the full length of said first enlarged section, said second enlarged section being disposed between said second region layer and the other end of said middle section and having one end close to said first region layer and the other end close to said middle section, said second enlarged section increasing gradually in width from the middle section toward said second region layer and over the full length of said second enlarged section; and a liquid in contact with and sandwiched between said upper and lower electrode layers of at least one of said first and second container units and said fluid channel unit;

whereby said liquid in one of said first and second micro containing spaces can be controllably transported to the other of said first and second micro containing spaces through said micro-channel by varying the difference between the electric field in said first and second micro containing spaces, and said liquid is extendable continuously from said first region layer through said middle region layer to said second region layer.

2. The liquid dielectrophoretic device of claim 1, wherein said first region layer has an end having a width substantially the same as that of the adjacent end of said first enlarged section of said middle region layer.

3. The liquid dielectrophoretic device of claim 1, wherein said second region layer has an end having a width substantially the same as that of the adjacent end of said second enlarged section of said middle region layer.

4. A liquid dielectrophoretic device comprising:

an upper assembly including an upper substrate and an upper electrode layer formed on said upper substrate:

a lower assembly including a lower substrate and a lower electrode layer formed on said lower substrate;

a first container unit defining a first micro containing space for containing a liquid therein and including an electrode pair for generating a dielectrophoretic force acting on the liquid in said first micro containing space by forming an electric field in said first micro containing space, said electrode pair being defined by said upper and lower electrode layers and having a first region layer;

a second container unit defining a second micro containing space for containing the liquid therein and including an electrode pair for generating a dielectrophoretic force acting on the liquid in said second micro containing space by forming an electric field in said second micro containing space, said electrode pair of said second containing unit being defined by said upper and lower electrode layers and having a second region layer; and a fluid channel unit defining a micro-channel between said first and second region layers of said first and second micro containing units, and including at least first and second enlarged sections proximate to said first and second region layers, respectively, and a middle section connected between said first and second enlarged sections, said first and second enlarged sections increasing gradually in width from said middle section to said first and second region layers, respectively, said first enlarged section having one end close to said region layer and the other end close to said middle section, said second enlarged section having one end close to said second region layer and the other end close to said middle section, the width of said first enlarged section increasing gradually over the full length of said first enlarged section, the width of said second enlarged section increasing gradually over the full length of said second enlarged section.

5. The liquid dielectrophoretic device of claim 4, wherein said fluid channel unit further includes an electrode pair for forming an electric field in said micro-channel, said electrode pair of said fluid channel unit being defined by said upper and lower electrodes and having a middle region layer disposed between said first and second region layers, said middle region layer having said middle section and said first and second enlarged sections.

6. The liquid dielectrophoretic device of claim 4, wherein said fluid channel unit further includes a capillary that defines said micro-channel and that has said first and second enlarged sections and said middle section, said first and second enlarged sections of said capillary being in spatial communication with said first and second micro containing spaces, respectively.

7. The liquid dielectrophoretic device of claim 4, wherein said first and second enlarged sections respectively have largest widths that are adjacent to and substantially as large as those of said first and second region layers of said first and second container units, respectively.

* * * * *